United States Patent [19]

Venturi

[11] 4,112,322

[45] Sep. 5, 1978

[54] PIEZOELECTRIC GAS IGNITER USING OPEN FRAME

[76] Inventor: Luigi Venturi, Via N. Castellini 3, Brescia, Italy

[21] Appl. No.: 752,322

[22] Filed: Dec. 20, 1976

[30] Foreign Application Priority Data

Dec. 23, 1975 [IT] Italy ..... 5259 A/75
Apr. 7, 1976 [IT] Italy ..... 5145 A/76

[51] Int. Cl.[2] ..... H01L 41/10
[52] U.S. Cl. ..... 310/339; 361/260
[58] Field of Search ..... 310/339; 361/260

[56] References Cited

U.S. PATENT DOCUMENTS

| | | | |
|---|---|---|---|
| 3,082,333 | 3/1963 | Hufferd et al. | 310/339 |
| 3,355,623 | 11/1967 | Konopa | 310/339 X |
| 3,819,963 | 6/1974 | Kondo et al. | 310/339 |
| 3,912,953 | 10/1975 | Edoardo | 310/339 |
| 3,976,900 | 8/1976 | Harrison | 310/339 |

FOREIGN PATENT DOCUMENTS

| | | | |
|---|---|---|---|
| 2,652,067 | 5/1977 | Fed. Rep. of Germany | 310/339 |
| 1,149,077 | 4/1969 | United Kingdom | 310/339 |

*Primary Examiner*—Mark O. Budd

[57] ABSTRACT

A piezoelectric gas igniter includes an outer body member having a frame support attached thereto. A window opening having two sides opposed to each other is formed in the frame support and a piezoelectric cartridge is positioned in the opening. A portion of a control lever is also positioned in the opening and an axially displaceable screw is threaded through the control lever so that the top of the screw engages the cartridge whereby both the cartridge and the control lever are angularly displaceable in opposite directions as a function of the displacement of the screw.

8 Claims, 7 Drawing Figures

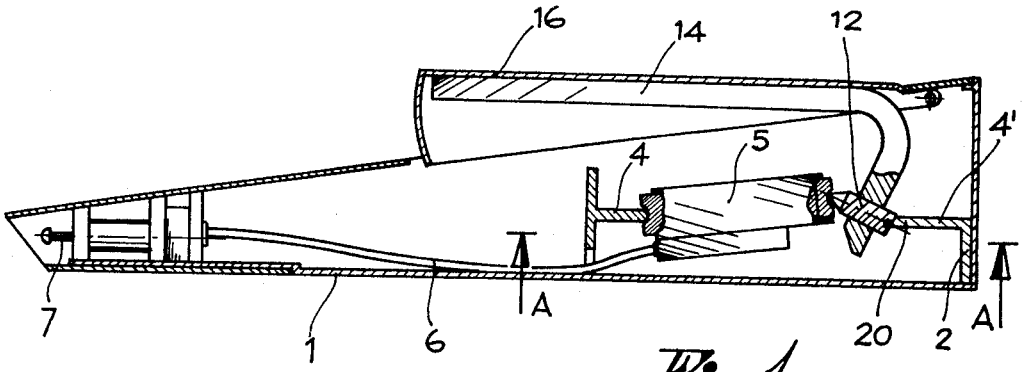
Fig. 1
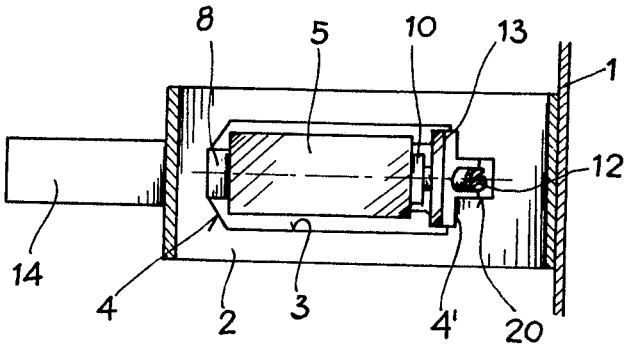
Fig. 2
Fig. 3
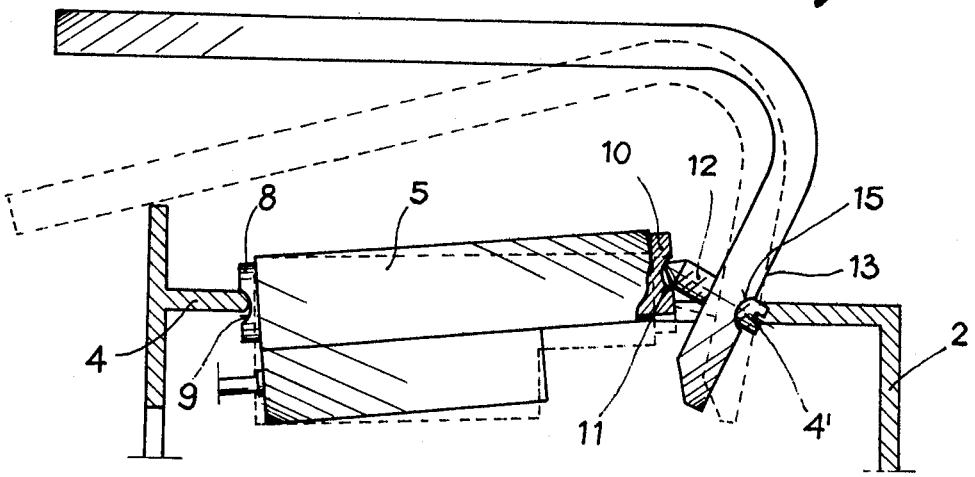

PIEZOELECTRIC GAS IGNITER USING OPEN FRAME

FIELD OF THE INVENTION

The present invention relates to a piezoelectric gas igniter of the type which has a piezoelectric cartridge oscillating about one extremity thereof when subjected to the action of a lever which determines the compression of the piezoelectric element to obtain a high voltage current and the resultant spark at one of the terminal electrodes.

BACKGROUND OF THE PRIOR ART

Igniters with an oscillating piezoelectric cartridge of the type mentioned above are known. The cartridge is generally positioned at one of the extremities of the device, on top of a screw, a ball, or similar stationary member. On the other extremity of the device there is a revolving member such as a pivot, a ball or a cam, associated with a lever or with a switch for determining (as a result of the displacements of said lever) the required compression of the piezoelectric element sufficient to obtain the spark.

The object of the invention is to provide a piezoelectric gas igniter having a simple and, therefore, economical structural configuration, wherein said screw, ball or similar stationary member is completely eliminated, while the compressive action on the opposed terminal or extremity of the cartridge is effected by means of a variable screw mounted on a control rocking lever which acts with its pivot point within a seat in said terminal or extremity.

It is another object of the invention to provide a simplified device and reduce the force required for the excitation of the piezoelectric element, so as to obtain a more sensitive and functional device.

Briefly stated, the igniter of the present invention comprises an outer body member to which there is attached a frame support having a window opening. This opening has two shorter sides opposed to each other. A piezoelectric cartridge is positioned in said window opening and is capable of oscillating. The cartridge has, on one side thereof, a slit or seat to receive and directly couple with one side of said window opening. On the other side, the cartridge has a second seat. A rocking control lever, bent to an L-shape, is provided, on the bent portion thereof, with a transverse slit for receiving therein and coupling with the side of the window opening opposite to the side on which the cartridge is positioned. The lever is provided with a screw, the point of which is engaged with the seat of the cartridge.

Further details of the invention will become evident from the following description thereof, with reference to the accompanying drawings, which are understood not to be limitative thereof, and in which:

FIG. 1 represents in elevational, longitudinal cross-section the device of the invention;

FIG. 2 is a plan view of the assembly of FIG. 1, taken along line A—A;

FIG. 3 is an enlarged and partially sectional elevational view of the control member of the device. The position assumed by the device during operation is shown in phantom;

Figure 4:
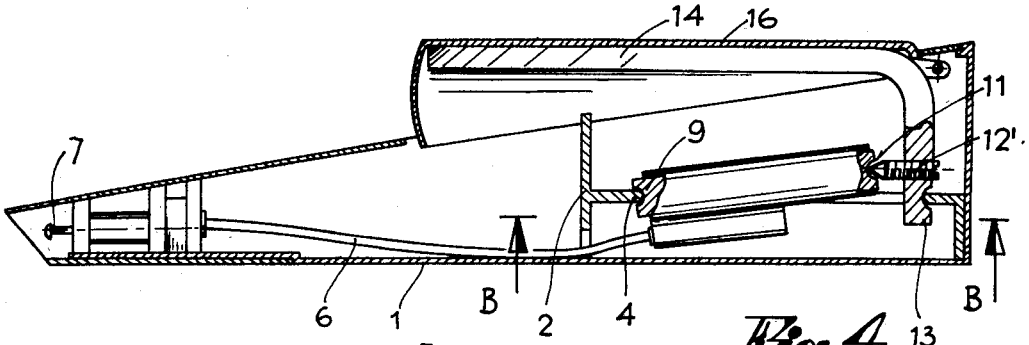
FIG. 4 represents a variant of the device of the invention.

Referring now to FIGS. 1–3 of the drawings, the igniter comprises an outer body member or envelope 1 to which there is attached a frame support 2 which defines a window opening 3 (FIG. 2). Window 3 has two smaller and opposed sides 4–4' between which a piezoelectric cartridge 5 is positioned. Cartridge 5 has a conducting cable 6 which feeds a terminal electrode 7. Electrode 7 produces the electrical sparks in association with the extremity of the body member.

At one end 8 of the piezoelectric cartridge there is provided a slit or diametric seat 9 for receiving and coupling with side 4 of window 3 of frame support 2. At the opposite end 10 of the piezoelectric cartridge 5 there is provided a seat 11 within which is engaged the point of screw 12. Screw 12 is mounted on the arm 13 of a control lever 14. Lever 14 is capable of performing angular displacements and, for this purpose, an arm 13 (on the surface facing opposite to the direction in which the point of screw 12 is facing) there is provided a slit or seat 15 for receiving and coupling with the side 4' of window 3 of frame support 2.

More particularly, the slit or pivot seat of the control lever 13–14 on side 4' of the window results in a transverse line (co-planar) with respect to screw 12. Furthermore, on said side 4' there is provided a slit 20 in juxtaposition with screw 12, so as not to impede the displacements of the screw together with the control lever. The screw is, in turn, variable so as to be advanced and withdrawn from the lever. This permits the mounting, readying and calibration of the assembled device, so that minimum, but sufficient force applied on the control lever, e.g. by means of switch 16 (attached to the body member 1) might actuate the cartridge and excite the piezoelectric device.

Figure 5:
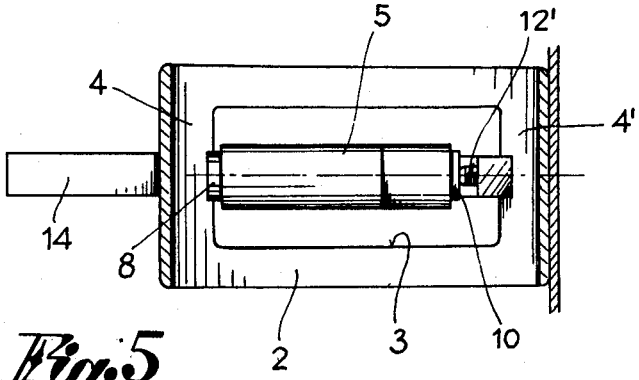
FIG. 5 is a view of the piezoelectric member alone, taken along line B—B of FIG. 4.
Figure 7:
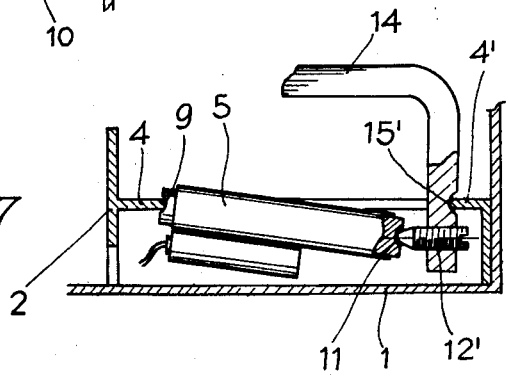
FIG. 7 shows a variant in the pivoting position of the rocking control lever.
Figure 6:
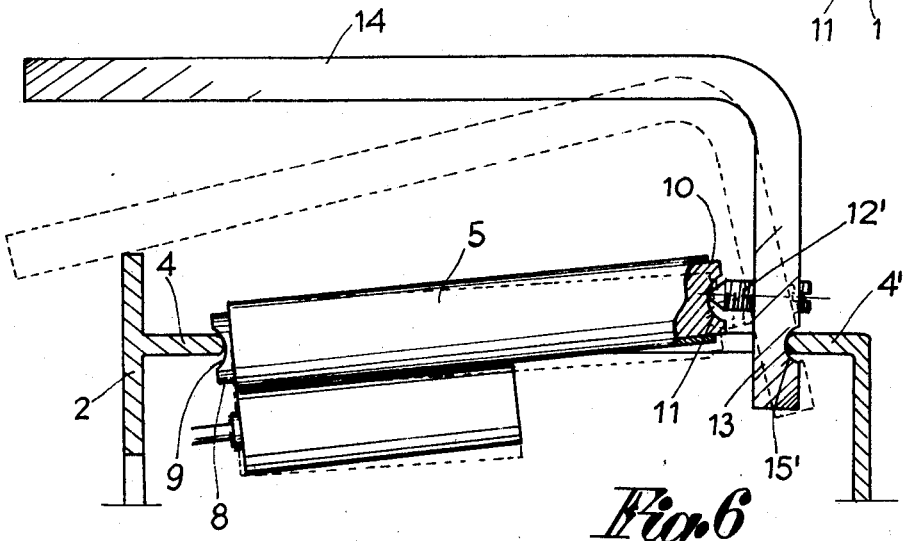
FIG. 6 shows in solid lines and in phantom, respectively, two extreme positions assumed by the piezoelectric cartridge during the excitation of the igniter.

Referring now to FIGS. 4–7 of the drawings, wherein identical reference numerals refer to identical elements, on arm 13 of the control lever 14 there is mounted a screw 12', the point of which engages within seat 11 of the piezoelectric cartridge 5. Seat 11 is opposite to seat or slit 9 coupled with side 4' of the frame support 2. On said arm of the lever there is also provided a slit or seat 15' which, instead of being coplanar with the screw as mentioned above, is displaced beneath (see FIGS. 4 and 6), or above (see FIG. 7) the screw 15', while achieving nevertheless the same results, that is, a compression force upon the cartridge.

In any event, in the igniter above-described, the piezoelectric cartridge 5 is directly pivotable on side 4 of the frame support 2, while the control lever 14 is, in turn, directly pivotable on the opposite side 4' of the said support 2 by means of the slit 15–15' of the lever. In this manner, the piezoelectric cartridge 5 is susceptible of angular displacement with a pivot formed by the side 4 of the support 2. Similarly, the lever 14 is susceptible of displacements with a pivot formed by the side 4' of the support 2.

Thus, by acting upon switch 16 of the igniter, one causes an angular displacement of the lever 14 to which corresponds (via screw 12–12') an angular displacement of the cartridge 5 about its base pivot and in a sense opposite to the displacement of the lever. The reciprocal motion between lever 14 and cartridge 5 exerts, always through screw 12–12', a considerable compressive force on the piezoelectric element, with the resultant production of a high voltage current and, consequently, a spark at the terminal electrode 7.

When the manual action on the switch 16 is terminated, the reaction against the compressive force on the piezoelectric element, returns the cartridge to its initial position and condition, and consequently, returns the lever to its inactive position.

However, also during this latter displacement the force developed between the screw 12 and the piezoelectric elements 5 creates the production of a spark at the terminal electrode.

It is to be further noted that screw 12–12' may be regulated on the lever by means of simple adjustment and calibration.

What is claimed is:

1. A piezoelectric gas igniter comprising an outer body member; a frame support attached to said body member; a window opening on said support and having two sides opposed to each other; an elongated, angularly displaceable piezoelectric cartridge positioned within said opening and having a slit on a first end thereof for receiving one of said opposed sides of said window opening therein, said cartridge having a seat on said second end thereof opposite said first end, a control lever that is angularly displaceable in a direction that is opposite said angular displacement of said cartridge, said control lever being coupled to said outer body member and having a first slit therein for receiving said other side of said opening therein; and an axially displaceable screw positioned with its tip engaged within said seat on the said second end of said cartridge, said screw being threaded through and movable together with said lever, said screw being adapted to compress said cartridge when said lever is angularly displaced.

2. The igniter according to claim 1 wherein said slit of said lever is coplanar with said screw.

3. The igniter according to claim 1, wherein said slit of said lever is planarly beneath the plane of said screw.

4. The igniter according to claim 1 wherein said slit of said lever is planarly above the plane of said screw.

5. The igniter according to claim 1, wherein said lever comprises a second slit therein, opposite said first slit and positioned in juxtaposition with said screw.

6. The igniter according to claim 1 wherein said opening has four sides and wherein said two opposed sides are shorter than the remaining sides.

7. The igniter according to claim 1 wherein said lever is L-shaped and is pivotally coupled at a portion intermediate the ends thereof to said outer body member.

8. The igniter according to claim 7 wherein one leg of said L-shaped member is shorter than the other leg thereof and said screw is threaded through said shorter leg.

* * * * *